United States Patent [19]

Page, Jr.

[11] 4,375,946

[45] Mar. 8, 1983

[54] WELL PUMP

[76] Inventor: John S. Page, Jr., 21372 Brookhurst St., No. 312, Huntington Beach, Calif. 92646

[21] Appl. No.: 255,770

[22] Filed: Apr. 20, 1981

[51] Int. Cl.[3] ..... F04B 21/02; F04B 21/06; F16K 15/14

[52] U.S. Cl. ..... 417/566; 417/567

[58] Field of Search ..... 137/853, 854, 849, 855; 417/259, 260, 559, 562, 569, 570

[56] References Cited

U.S. PATENT DOCUMENTS

| | | | |
|---|---|---|---|
| 251,256 | 12/1881 | Lewis | 417/430 |
| 2,191,969 | 2/1940 | Meiser | 137/855 X |
| 2,615,401 | 10/1952 | Mock | 417/260 |
| 2,902,049 | 9/1959 | Ilfrey et al. | 417/566 X |
| 3,046,904 | 7/1962 | Crow | 417/559 X |
| 3,143,080 | 8/1964 | Sutliff | 417/554 |
| 3,187,680 | 6/1965 | Sutliff | 417/567 |
| 4,176,714 | 12/1979 | Case | 74/581 X |
| 4,219,311 | 8/1980 | Simon | 417/260 |

*Primary Examiner*—William L. Freeh

*Attorney, Agent, or Firm*—William W. Haefliger

[57] ABSTRACT

Well fluid pumping apparatus comprises:

(a) body structure defining an upright plunger bore, (b) a plunger reciprocable in that bore, (c) the body structure also defining a chamber sidewardly offset from an axis defined by the plunger bore and communicating with the bore, and (d) valving carried by the body structure to pass intake fluid via the chamber into the plunger bore in response to stroking of the plunger in one direction in the bore, and to pass discharge fluid from the plunger bore into and from the chamber in response to stroking of the plunger in the opposite direction in the bore.

12 Claims, 6 Drawing Figures

WELL PUMP

BACKGROUND OF THE INVENTION

This invention relates generally to the pumping of wells, and more particularly concerns highly advantageous pumping apparatus characterized as solving problems associated with such pumping.

Fluid wells such as oil wells must be pumped when natural or other oil field pressure drops below certain limits. Such pumping frequently involves vertical reciprocation of so-called sucker rods connected to a pump plunger at the sub-surface pump location. For example, as the plunger moves up, a valve ball in the top of the plunger seats and lifts the fluid up into the production tubing. At the same time, a valve ball in the pump barrel or chamber opens and allows fluid from the well to enter into the barrel interior. A typical tubing pump may have a plunger diameter of 2¾ inches and is attempting to pull in fluid at a displacement rate corresponding to 5.94 square inches of area; however, the area through the standard A.P.I. seat is only 2.07 square inches. This restriction prevents maximum filling of the barrel chamber and thus a loss in pump efficiency is experienced.

On the plunger down stroke, the ball valve in the top of the plunger opens, and the valve in the barrel closes, trapping the fluid and forcing it up through the upper valve in the plunger. The orifice in the valve in the top of the plunger causes an extremely high restriction, and fluid resistance. Such high fluid resistance in turn causes the pump rods to go into compression, producing accelerated fatique and premature breakage of the rods. This resistance also shows the descent of the rods so that the strokes per minute are limited and flow of pumped fluid is also undesirably limited. Furthermore, undesirably elevated pressures are produced within the pump barrel or chamber as the weight of the rods trying to fall is supported by the trapped fluid below the plunger. Although the traveling valve in the top of the plunger is open allowing the trapped fluid to be displaced up through the plunger; the annular seat in that valve is so small that it commonly has only 20 to 22% as much square inch area as the area of the plunger. The elevated pressure also causes extra wear between the sealing surfaces of the plunger and barrel, as well as abrupt imparting of downward impacts on the tubing string, causing fatigue at the threaded coupling joints.

Additional problems with such operation include stretching and unstretching of the very long rod string during its reciprocation, which produces undesirable motion of the pump plunger, interfering with pump operation and reducing pumping efficiency. This leads to limited production from a given pump, at depth. Also, the pump orifices restrict the flow to undesired extent, limiting production. Therefore, there is great need for pumping apparatus which will overcome these practical difficulties.

SUMMARY OF THE INVENTION

It is a major object of the invention to provide pumping apparatus meeting the above need, and thereby allowing increased petroleum production. Basically the invention achieves this objective through so locating the pump elements as to minimize stretching and unstretching of the rod string during reciprocation to operate the pump, and with reduced restriction to inflow of fluid into the pump, and reduced restriction to outflow of fluid from the pump. As will appear, the pump plunger is located at a level lower than the level of the valving, so that fluid flows into the pump and downwardly into the plunger bore, the bottom end of said bore being open to well fluid, and there being a piston surface on the upper end of the plunger for maintaining downward force exertion on the plunger so that unstretching of the rod string is minimized or eliminated; and the pump valving is located to enable use of maximum size flow ports into and from the valve chamber.

Other objectives include the use of a rod shock absorber in conjunction with the improved pump to further smooth the operation of the rod string; the provision of valve ball and seat elements in sidewardly offset relation to the plunger axis as will appear; the provision of an elastomeric, radially movable valve stopper; and the provision of a poppet-type discharge valve arrangement through which the plunger stem projects.

These and other objects and advantages, as well as the details of illustrative embodiments, will be more fully understood from the following description and drawings, in which:

DRAWING DESCRIPTION

DETAILED DESCRIPTION

Figure 1:
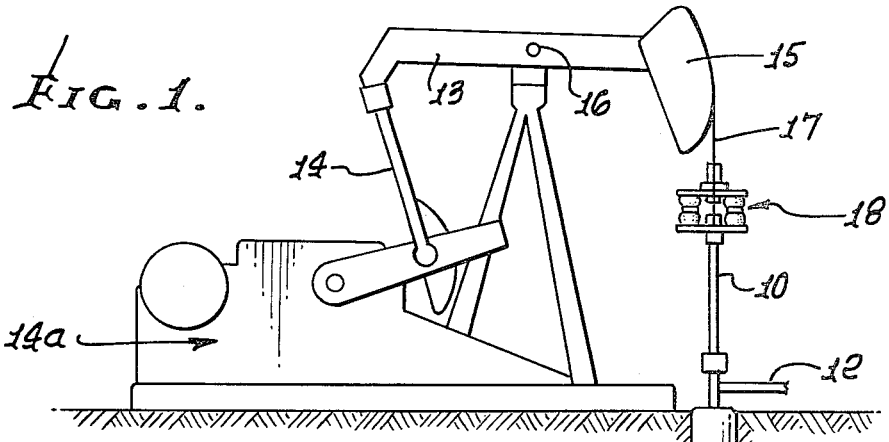
FIG. 1 is a vertical elevation showing one form of the invention.

In FIG. 1, a well sucker rod 10 is vertically reciprocable in well 11, cased at 11*a*, for pumping fluid such as oil to the surface and to a lateral flow line 12. A pumping unit to reciprocate the rod 10 vertically may comprise a rocker arm 13 connected by link 14 to a rotary drive 14*a*. A horsehead 15 on arm 13 (which is pivoted at 16) suspends cables 17 that wrap and unwrap on the horsehead as the latter moves up and down. Shock absorber or cushioning unit 18 is connected between the cables 17 and rod 10 to cushion the lifting and lowering forces transmitted between the rod 10 and cables 17, and thereby reduce wear, and aid in oil production. See in this regard my copending application Ser. No. 216,321, filed Dec. 15, 1980.

The well fluid pumping apparatus also includes body structure defining an upright plunger bore, and a plunger reciprocable in that bore, in response to up and down stroking of the rod string 10. See for example the body structure 20 defining the upright bore 21 within which plunger 22 is reciprocable. As illustrated, the body structure 20 may for example include an upper, relatively larger diameter tubular body member 20*a* and a lower, relatively smaller diameter tubular member or barrel 20*b*. The thread of pin end 23 of the latter is connected into the threaded bore 24 in bottom wall 25 of member 20*a*.

The illustrated plunger 22 includes lower tubular part 22*a*, and a plug 22*b* connected at 26 to part 22*a*, whereby the plug or part, or both, may have slidable fit with the bore 21. A vertically elongated stem 27 is connected at its opposite ends 27*a* and 27*b* with the rod 10 and the plug 22*b*, to transmit reciprocation to the plunger. Stem 27 extends upwardly within the lower interior 28 of the body member 20*a*, through an opening 29 in transverse wall 30 of the member 20*a*, and through a tube pipe 31 extending upwardly within the upper interior 32 of the body member. Pipe 31 is thread connected at 31*a* to wall 30.

The body member 20*a* is carried or suspended at 34 by production tubing 35, extending lengthwise in the well, and pipe 31 as well as rod string 10 extend upwardly into tubing, as shown.

Figure 2:
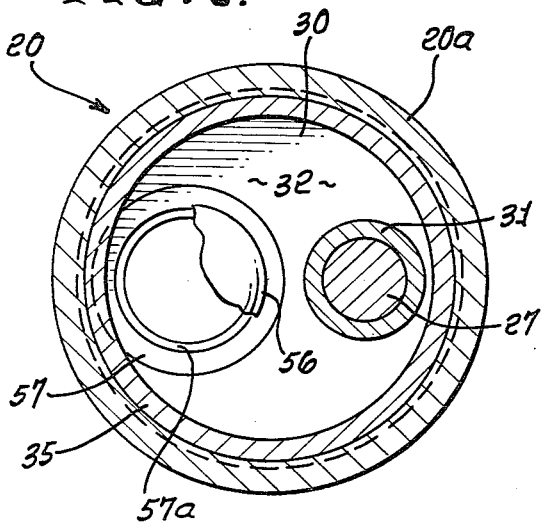
FIG. 2 is a horizontal section on lines 2—2 of FIG. 1.

In accordance with the invention, the body structure defines chamber means offset from the plunger bore and in communication with same. Also valve means is carried by the body structure to pass intake fluid via the chamber means into the plunger bore in response to stroking of the plunger in one direction (as for example downwardly) in the bore, and to pass discharge fluid from the plunger bore into and from the chamber means in response to stroking of the plunger in the opposite direction (as for example upwardly) in the bore. In the FIGS. 1 and 2 example, the body structure 20 defines a chamber means such as chamber 40 laterally or sidewardly offset from the plunger bore 21, or from the bore axis 21*a*, but in communication with that bore, above the plunger 22, via fluid transfer port or porting 41. The latter may for example be formed, as shown, between transverse walls 25 and 30.

The illustrated embodiment of the valve means includes a fluid intake valve stopper such as ball 44 and seat structure in communication with the chamber means, and exposed to the transfer porting 41. Such seat structure may include a seat ring 46 retained in a vertical through opening 47 in bottom wall 25, or via an annular retainer 48 having threaded connection at 48*a* with wall 25. On downstroking of the plunger 22, fluid in the well zone 49 outside the intake port 50 is drawn in through that port, into chamber 40 (ball 44 being sucked upwardly to open position indicated by broken lines 44*a*), through transfer port 41, and into the plunger bore 21, above the plunger. Note chamber shoulder 51 limiting upward movement of ball 44*a*. The stem 27 is of sufficient diameter, but less than the diameter of bore 21, to allow filling of fluid into annular space 52 above plunger 22, and also to block entrance of ball 44 into that space.

The illustrated embodiment of the valve means also includes a discharge valve stopper such as ball 56, and seat structure in communication with the side chamber means, and also exposed to the transfer port 41. Such seat structure may include a seat ring 57 retained in an annularly recessed seat 58, that extends coaxially with an opening 59 through transverse wall 30. On downstroking of the plunger 22 acting to fill space 52 above the plunger, ball 56 is held downwardly on the seat 57*a* by the fluid standing above that ball in tubing 35. On upstroking of that plunger, ball 44 drops into its seat 46*a*, and ball 56 is lifted by fluid pressure in chamber 40, so that fluid transfers from space 52, through port 41 and chamber interior (i.e. upright zone) 40, upwardly through the opening 59 and the ring 57 into the tubing 35.

Figure 3:
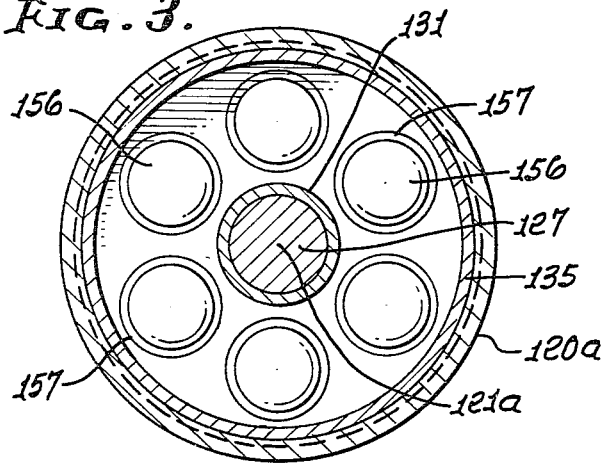
FIG. 3 is a view like FIG. 2, but showing a modification.
Figure 3:
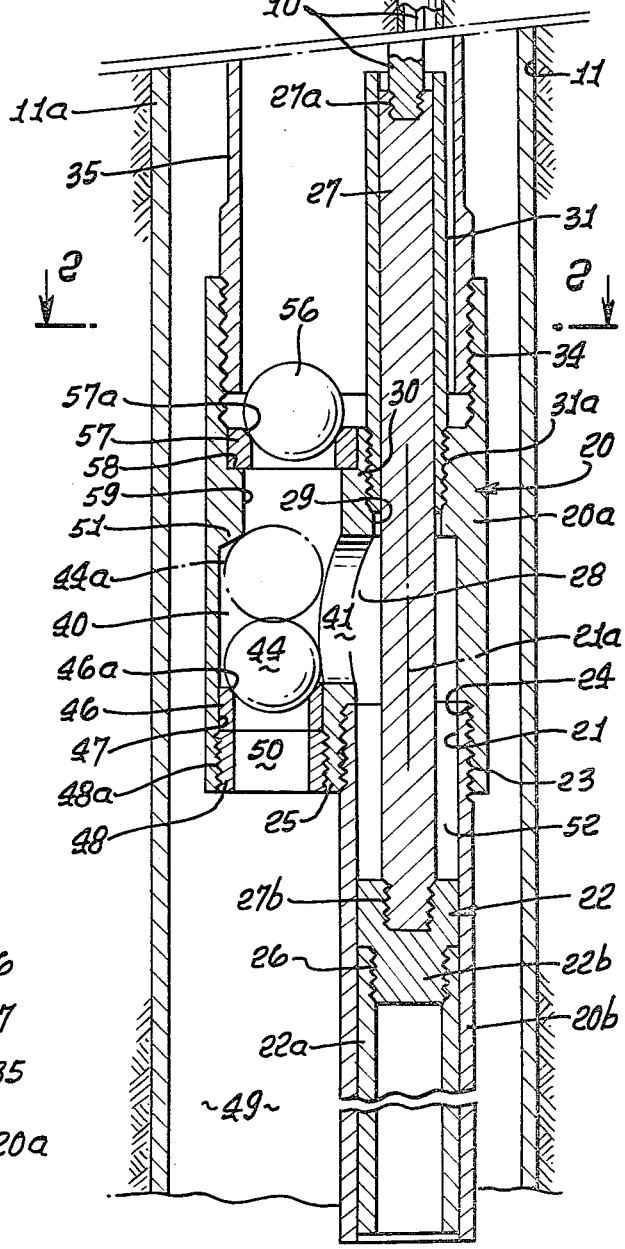

FIG. 3 shows a modification wherein several valve balls 156 (corresponding to balls 56) are clustered above an axially or centrally located stem 127 and barrel 131 (corresponding to stem 27 and barrel 31). Elements 120*a*, 135 and 157 correspond to elements 20*a*, 35 and 57, respectively. Thus, the balls are spaced about the axis 121*a* of reciprocation of the plunger associated with the stem.

In FIG. 1, the plunger part 22*a* remains exposed to the well fluid and the well below the level of the valving means as described. Also, the balls 44 and 56 and their seats are typically made of steel.

Figure 4:
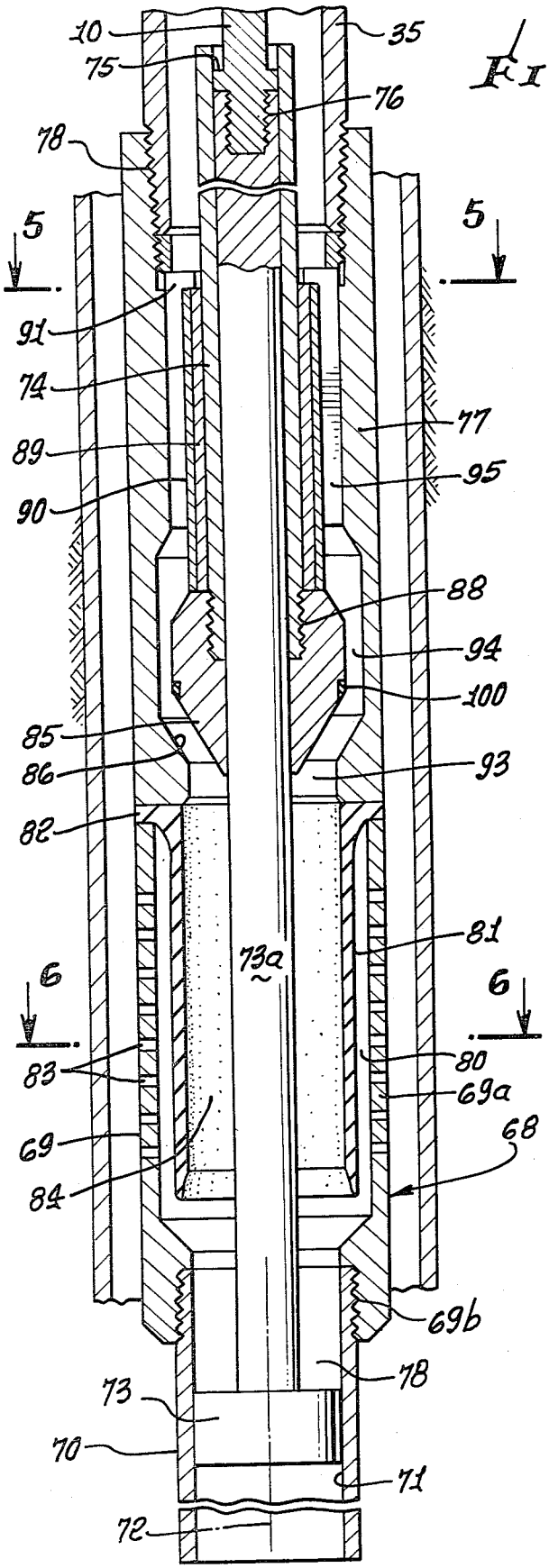
FIG. 4 is a vertical elevation like FIG. 1, but showing a further modification.
Figure 5:
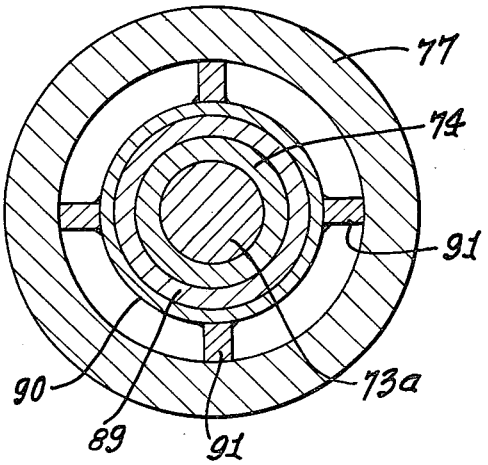
FIG. 5 is a section on lines 5—5 of FIG. 4.
Figure 6:
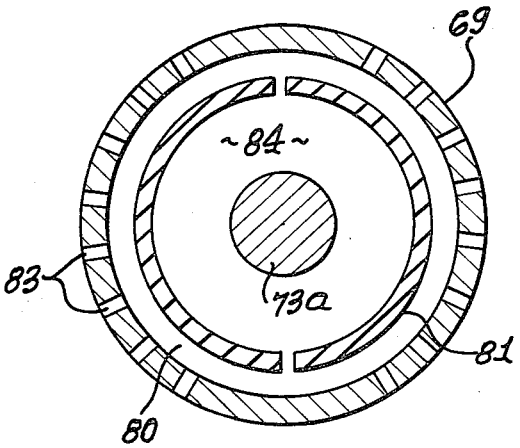
FIG. 6 is a section on lines 6—6 of FIG. 4.

In FIGS. 4–6, body structure 68 includes a lower barrel or tubular member 70 defining an upright plunger bore 71 having an axis 72. A plunger 73 is vertically reciprocable in bore 71, having sliding engagement with same. A central stem 73*a* extends upwardly from the plunger, and has connection at its upper end with sucker rod string 10. See connection 76 A sealing tube 74 surrounds the upper extent of the stem, and a piston surface is provided at 75 on the interconnected stem and rod string to receive downward pressure exerted by fluid in tubing 35. That pressure application serves to urge the stem 73*a* and the plunger 73 downwardly, so that the rod string remains tensioned during pumping, overcoming problems of rod string stress reversal.

The body structure 68 also includes a tubular member 69 connected at 69*b* to the barrel 70, and another tubular member 77 above member 69, and suitably connected thereto. Member 77 is connected at 78 with the lower end of tubing 35. Of advantage is the fact that the body structure of FIG. 4 is enabled to have smaller outside diameter than the body structure of the pumping apparatus of FIG. 1.

Chamber means is defined by the body structure to extend in sidewardly offset relation to the axis 72 of plunger bore 73 and also to communicate with that bore. In this regard, members 69 and 77 are coaxial with axis 72 and barrel 70. Such chamber means also extends above the level of the plunger 73, for passing well fluid into the plunger bore space 78 as the plunger strokes in one direction, and for passing discharged well fluid from space 78 into the tubing 35 as the plunger strokes in the opposite direction. Such chamber means includes a first portion indicated at 80 between an elastomeric sleeve 81 and a tubular wall 69*a* of the body member 69. The sleeve 81, extends about axis 72, and is suspended as at 82 to hang downwardly in radially outwardly spaced relation to stem 73*a*. The sleeve normally hangs in radially inwardly spaced relation from ports 83 in wall 69*a* to allow passage of well fluid in through ports 83 and downwardly in chamber portion 80 to flow into fill space 78 above the plunger 73, during down-stroking of that plunger. Conversely, the sleeve is radially movable outwardly, by fluid pressure in space 84, to engage wall 69*a* and close off ports 83 during passage of fluid from the plunger bore (i.e. in fill space 78) upwardly under pressure and through space 84, as the plunger is upstroked.

The valve means includes valve stopper and seat elements, as at 85 and 86, which are annular to pass the stem 73*a*, so that the latter may reciprocate independantly of movement of valve stopper or poppet 85 toward and away from seat 86. Note that these elements have matching tapers.

A movable guide means in the form of sealing tube 74 is attached at 88 to the stopper 85 and projects upwardly coaxially of the stem 73*a*. The tube 74 loosely seals off about that stem. A fixed guide means is integral with the body structure 77, and extends in axially guiding relation with the tube 74. It includes a bronze tubular bushing 89 carried by a tubular housing 90 attached, via circularly spaced support webs or fins 91, to the body 77.

A second portion of the chamber means as referred to above is located at 93 between body 77 and stem 73*a*, for passing pumped fluid upwardly for flow past open valve elements 85 and 86, and upwardly through passage 94 between the valve stopper and the body, and at 95 between the housing 90 and the body, the flow then entering the tubing 35. The flow areas (in planes normal to axis 72) at 78, 84, 93, 94 and 95 are typically approximately equal, and may be equal to the flow area at 80, for enhanced flow efficiency.

An annular elastomeric or other non-metallic material seal 100 on stopper 85 is engageable with seat 86, when the stopper is seated.

Sleeve 81 may be split, lengthwise, as at two diametrically opposite locations as seen in FIG. 6, to form flaps so as to more easily flex outwardly to cover the openings 83, arranged in two sets opposite the sleeve or flap sections.

I claim:

1. In well fluid pumping apparatus, the combination comprising (a) body structure defining an upright plunger bore, (b) a plunger and a plunger stem reciprocable in said bore, (c) the body structure also defining chamber means sidewardly offset from an axis defined by said plunger bore and communicating with said bore, and (d) lower valve means carried by said body structure to pass intake fluid via said chamber means into said plunger bore in response to stroking of the plunger in one direction in said bore, and to pass discharge fluid from said plunger bore into and from said chamber means in response to stroking of the plunger in the opposite direction in said bore, (e) the plunger bore into which liquid is passed being below the level of said valve means, the plunger extending generally vertically, the bore being open to the well below the apparatus, (f) the valve means including an elastomeric sleeve extending about an axis defined by the plunger, the sleeve being radially movable away from valve ports defined by said valve means to allow said passage of fluid into said plunger bore, and the sleeve being radially movable toward said ports to close the ports during said passage of fluid from said plunger bore, the stem extending upwardly through said sleeve, (g) upper valve means including valve elements located above the level of the lower valve means, one of said valve elements being movable relative to the other element and the valve elements when relatively open defining an annularly extending flow path which is upwardly open, the stem being reciprocable with the plunger, independently of movement of said movable element, the stem extending upwardly through said upper valve means, (h) guide means associated with one element of the upper valve, said stem extending through said guide means for reciprocation relative to said guide means, (i) the plunger having an up-position in which it is openly spaced below the lower valve means, and the plunger bore extending downwardly from a location immediately below the lower valve means whereby a straight through annular flow path is provided in approximate alignment with said flow path through the upper valve means for passing fluid flow upwardly from said bore and through the elastomeric sleeve and the upper valve means, in response to upward movement of the plunger, (j) the entirety of the lower valve means located within a vertical extension of a cylinder defined by an outer surface of said body.

2. The combination of claim 1 wherein said plunger has its under-side openly exposed to the well and fluid therein below the plunger, the plunger having a body that extends across said bore and everywhere blocking communication therethrough between well fluid at the underside of the plunger and well fluid passed into the plunger bore above the plunger via said valve means.

3. The apparatus of claim 1 including a tensioning piston surface operatively connected with the stem and facing upwardly to exert tensioning force on the sucker rod string in response to downward fluid pressure exertion on said surface as the plunger strokes up and down in said bore, said surface located above said upper and lower valve means.

4. The apparatus of claim 1 including a sucker rod string connected to said plunger stem, the lowermost end of the plunger remaining in open communication with the well below the level of said valving means.

5. The apparatus of claim 4 including sucker rod shock absorbing apparatus connected with said sucker rod string.

6. The apparatus of claim 4 including a well pumping unit connected to the rod string.

7. The apparatus of claim 1 wherein said upper valve means elements include annular valve stopper and seat elements through which the plunger stem extends, the stem being reciprocable with the plunger, independently of movement of the stopper element.

8. The apparatus of claim 7 wherein the valve stopper element is seated on the seat element when the elastomeric sleeve is spaced from the ports during passage of fluid into the plunger bore, and the valve stopper element is spaced from the seat element when the elastomeric sleeve closes said ports during said passage of fluid from the plunger bore and upwardly through the seat element.

9. The apparatus of claim 7 including movable guide means integral with the stopper element, and through which said stem extends for reciprocation relative to said guide means.

10. The apparatus of claim 9 including fixed guide means integral with said body structure and in guiding engagement with said movable guide means.

11. In well fluid pumping apparatus, the combination comprising (a) body structure defining an upright plunger bore, (b) a plunger reciprocable in said bore, (c) the body structure also defining chamber means sidewardly offset from an axis defined by said plunger bore and communicating with said bore, and (d) valve means carried by said body structure to pass intake fluid via said chamber means into said plunger bore in response to stroking of the plunger in one direction in said bore, and to pass discharge fluid from said plunger bore into and from said chamber means in response to stroking of the plunger in the opposite direction in said bore, (e) the plunger bore into which liquid is passed being below the level of said valve means, the plunger extending generally vertically, (f) the valve means including an elastomeric sleeve extending about an axis defined by the plunger, the sleeve being radially movable away from valve ports defined by said valve means to allow said passage of fluid into said plunger bore, and the sleeve being radially movable toward said ports to close the ports during said passage of fluid from said plunger bore, (g) the valve means including annular valve stopper and seat elements through which a plunger stem extends, the stem being reciprocable with the plunger, independently of movement of the stopper element, (h) movable guide means integral with the stopper element, and through which said stem extends for reciprocation relative to said guide means, (i) and including a tensioning piston integral with the stem, the piston having a fluid pressure receiving surface facing upwardly within the movable guide means which is tubular.

12. The apparatus of claim 11 including a sucker rod string attached to said stem.

* * * * *